United States Patent [19]

Langeder

[11] Patent Number: 4,610,586

[45] Date of Patent: Sep. 9, 1986

[54] APPARATUS FOR DEBURRING OF WORKPIECES

[75] Inventor: Rudolf Langeder, Mauthausen, Austria

[73] Assignee: Voest-Alpine Internation Corporation, New York, N.Y.

[21] Appl. No.: 652,263

[22] Filed: Sep. 20, 1984

[30] Foreign Application Priority Data

Oct. 13, 1983 [AT] Austria ..... 3650/83

[51] Int. Cl.[4] ..... B23D 1/22

[52] U.S. Cl. ..... 409/300; 409/301

[58] Field of Search ..... 409/297, 300, 301, 303, 409/308, 309, 310, 311, 312

[56] References Cited

U.S. PATENT DOCUMENTS

| | | | |
|---|---|---|---|
| 2,503,476 | 4/1950 | Glover | 409/301 |
| 2,602,378 | 7/1952 | Morton | 409/297 |
| 4,362,448 | 12/1982 | Hasebe et al. | 409/300 |
| 4,498,821 | 2/1985 | Cazaux | 409/300 |

FOREIGN PATENT DOCUMENTS

| | | | |
|---|---|---|---|
| 3037320 | 4/1981 | Fed. Rep. of Germany | 409/300 |
| 47810 | 10/1978 | Japan | 409/301 |
| 565778 | 7/1977 | U.S.S.R. | 409/301 |

*Primary Examiner*—William R. Briggs

*Attorney, Agent, or Firm*—Horst M. Kasper

[57] ABSTRACT

A knife support is part of the apparatus, and with a knife it passes by at the edge of the work piece which is to be deburred. The edge of the knife corresponds in its length at least to the length of the edge to be deburred. In order to be able to shear both the front end and the rear end of slabs with one and the same construction in a simple and sturdy way, the knife support is provided as a rocker arm which can be moved with a pivot drive. The swivel axis of the rocker arm can be directed about parallel to the edge of the work piece to be deburred.

21 Claims, 9 Drawing Figures

APPARATUS FOR DEBURRING OF WORKPIECES

BACKGROUND OF THE INVENTION

1. Field of the Invention

The invention relates to an apparatus for the deburring of workpieces, in particular of continuously cast slabs, where a knife is mounted and attached to a knife support, which knife support can be moved past the edge of workpiece to be deburred, and where the knife edge has a length which corresponds at least to the length of the edge be deburred.

2. Brief Description of the Background of the Invention Including Prior Art

An apparatus for the deburring of continuous cast slabs is known from the German Patent Application Laid Open DE-OS No. 3,037,320. The edge of the knife can be moved along the output roller table by way of a carriage to which the knife is attached. The railtrack of the carriage can be lifted and lowered with its own lift provision. According to this apparatus the knife is placed at the lower surface of the slab by lifting of the track support of the carriage and then the carriage is moved along the slab surface so that the flash generated by flame cutting is sheared off and disposed at the start or, respectively, at the end of the slab.

This apparatus has disadvantages which are associated in particular with its heavy and bulky construction, with the movable carriage, as well as with the liftable and lowerable rail track for the carriage. It is only possible with the known apparatus to remove the flash at one end of the slab. To remove the flash at the other end of the slab, requires the use of a second apparatus constructed oppositely to the known apparatus because of the direction of motion of the knife which runs parallel to the lower surface of the slab.

SUMMARY OF THE INVENTION

1. Purposes of the Invention

It is an object of the present invention to avoid the difficulties and disadvantages of the prior art and to provide a cutting apparatus for removing flashes, which is of simple construction and which is stable and reliable under heavy industrial conditions.

It is another object of the invention to provide an assured shearing of flashes both at the front and at the rear end of the workpieces with one and the same apparatus. It is a further object of the invention to provide an apparatus for the deburring of continuously cast slabs which does not require rails and tracks for the support of a knife, but where the knife is moved by simple hydraulic means.

These and other objects and advantages of the present invention will become evident from the description which follows.

2. Brief Description of the Invention

The present invention provides an apparatus for the deburring of work pieces, in particular for the deburring of flame cut slabs, comprising a pivot drive, a rocker arm rotatable around a swivel axis and movable by the pivot drive and a knife having an edge and mounted at the rocker arm where the length of the knife edge corresponds at least to the length of an edge of the work piece to be deburred. The rocker arm can be moved past the edge of the work piece to be deburred, and the swivel axis of the rocker arm is directed approximately parallel to the edge to be deburred. The rocker arm is provided as a box girder with smooth outer surfaces. Two knife edges are provided at the rocker arm acting in opposite directions of motion of the rocker arm. The apparatus also comprises means for rocking the rocker arm around the swivel axis back and forth relative to the edge of the work piece to be deburred, a swivel lever which rotatably supports the swivel axis of the rocker arm and means for adjusting the position of the swivel lever for pressing both against the edge of the workpiece to be deburred and in the opposite direction with a predetermined force.

In the apparatus of the present invention the shortest straight line connecting the swivel axis of the rocker arm to the part of the knife edge engaging the edge to be deburred encloses obtuse angles $>90$ degrees with the substantially planar surfaces of the work piece forming the edge to be deburred.

The apparatus also comprises an output roller table of a continuous casting plant with two neighboring rollers supporting the bottom surface of continuous cast slabs, where the two knife edges are movable between the two neighboring rollers; a first stop, where the front end, in the output direction of the slab rests at a distance relative to and away from the vertical position of the rocker arm; and a second stop, where the rear end of the slab, relative to the output direction, rests at a distance relative to and away from the vertical position of the rocker arm. There is also a support traverse, which can be brought into the guiding path of the output roller table and which can be removed out of the guiding path of the output roller table, and which support traverse is disposed in stopping position approximately vertically above the swivel axis of the rocker arm. A reversible driver is connected to at least one of the rollers of the output roller table, where the roller is disposed on the output part of the roller table downstream from the vertical position of the rocker arm.

In the apparatus for the deburring of work pieces of the present invention the length of the rocker arm is from about one to eight times the diameter of the rollers on the roller table, the diameter of the support traverse is from about 0.5 to 2 times the diameter of the rollers on the roller table, and the location of the swivel axis on the swivel arm has a distance from the pivot point of the swivel arm, which is about 0.2 to 2 times the length of the rocker arm. The length of the rocker arm is from about 1.5 to 5 times the diameter of the rollers on the roller table, the diameter of the support traverse is from about 0.1 to one times the length of the rocker arm, and the location of the swivel axis on the swivel arm has a distance from the pivot point of the swivel arm, which is about 0.4 to 1 times the length of the rocker arm.

The apparatus is provided with two rocker arms each with a knife set and disposed around a single swivel axis, where the angle between the two rocker arms is larger than double the angle between a line from the swivel axis to the center of the support traverse and a line between the swivel axis and a stop of the support traverse.

Thus according to the invention the knife support is provided as a movable rocker arm driven by a pivot drive around a swivel axis, which swivel axis is directed about parallel to the edge of the workpiece to be deburred.

In order to position the knife in a simple way at the workpiece, and in particular in cases where the edge to be deburred has a position which deviates from the regular position, it is advantageous that the swivel axis of the rocker arm can be moved in the direction toward the edge to be deburred and in an opposite direction by means of a position adjustment provision.

In order to avoid a smearing of the knife edge over larger surface areas of the workpiece, the swivel axis of the rocker arm encloses an obtuse angle larger than 90 degrees formed by the shortest straight line connecting the swivel axis of the rocker arm to the part of the knife edge engaging the edge to be deburred, and the surfaces of the workpiece to be deburred.

In order to be able to remove the flashes at the two ends of a single workpiece according to a preferred embodiment, two knife edges are provided, with opposite directions for opposite directions of motion of the rocker arm. To assure contacting of the slab during the deburring process at its rear end at the stop it is advantageous to have at least one roller of the rollers on the output side of the roller table connected to a reversible drive.

In order to avoid interference with the apparatus by falling flash pieces, or, respectively, in order to avoid a sliding of the flashes at the apparatus, it is advantageous if the rocker arm is provided as box girder beam with a smooth outer surface.

The features which are considered as novel for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
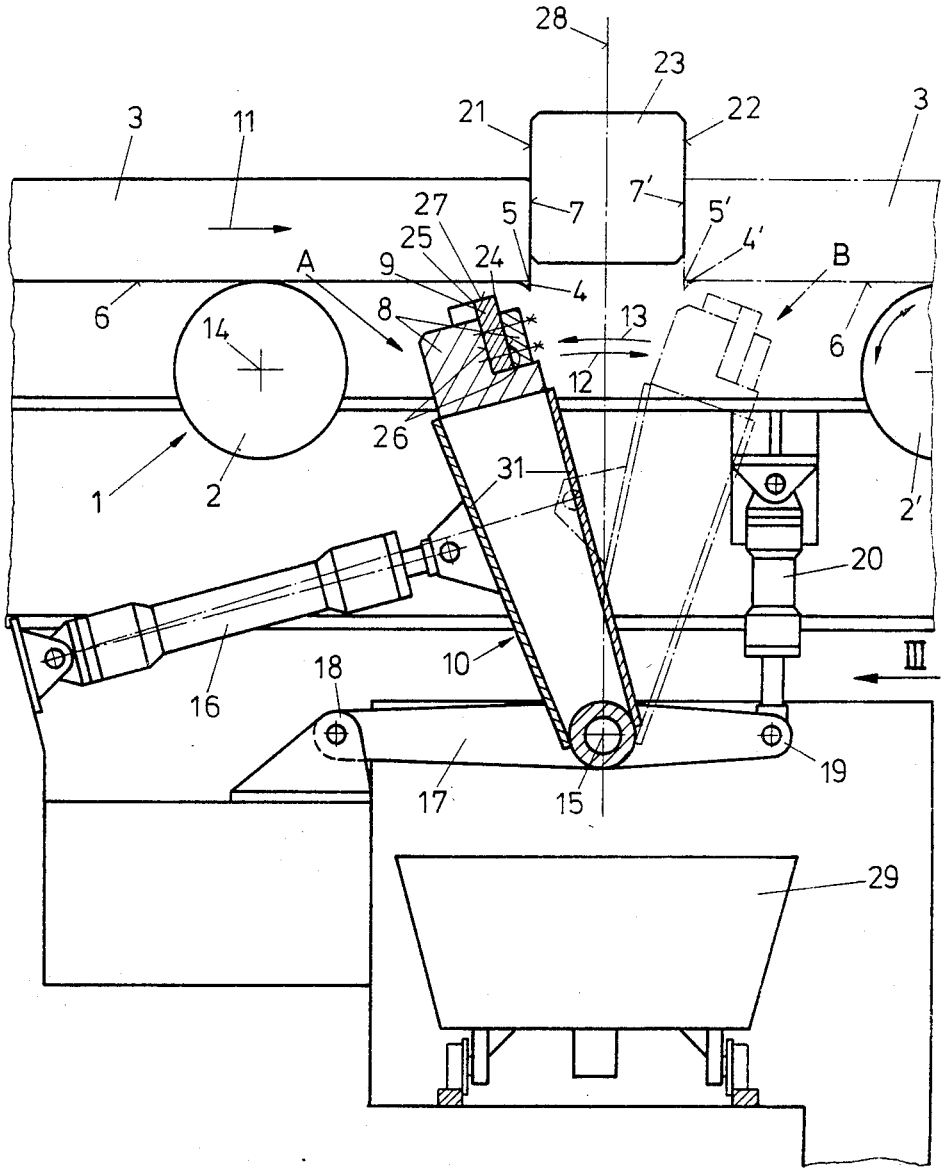
FIG. 1 is a partially sectional schematic of an apparatus for deburring of workpieces.

In accordance with the present invention, an apparatus for the deburring of workpieces, and in particular of continuously cast slabs 3, is provided with a knife support 10 which can be moved past the edge 5,5' of the workpiece to be deburred, and which has mounted a knife 9, where the knife edge 24,25 has at least a length which corresponds to the length of the edge 5, 5' to be deburred. The knife support can be provided as a rocker arm 10 movable with a pivot drive 16. The swivel axis 15 of the rocker arm is directed about parallel to the edge 5, 5' of the workpiece to be deburred. The swivel axis 15 of the rocker arm 10 can be moved in the direction toward the edge 5,5' to be deburred and in an opposite direction with a positioning provision 16. The rocker arm 10 can be disposed tiltable at a rocking lever 17. The swivel lever 17 can be pressed in the direction toward the edge 5,5' of the workpiece to be deburred and in the opposite direction with a positional adjustment provision 20 with a predetermined force. The swivel axis of the rocker arm can enclose an obtuse angle larger than 90 degrees formed by the shortest straight line 33,33' connecting the swivel axis of the rocker arm to the part of the knife edge engaging the edge 5,5' to be deburred, and the surfaces 6,7,7' of the workpiece to be deburred. The rocker arm 10 can be provided with two knife edges 24,25 which are acting in opposite directions 12,13 to the motion of the rocker arm 10.

The apparatus can be employed in particular with a continuous casting apparatus to deburr continuously cast slab 3 cut into sections. The knife edges 24, 25 can be movable between two neighboring rollers 2, 2' supporting the lower surface 6 of the continuously cast slabs, where the rollers 2, 2' are part of an output roller table 1 of a continuously casting plant. A stop 21 can be provided which provides means for arresting the front end of the slab 3 in the output direction 11 at a distance from the vertical position 28 of the rocker arm 10. A further stop 22 can be provided where the rear end of the slab 3 rests at a distance from the vertical position 28 of the rocker arm 10.

Two stops 21, 22 can be provided at one support traverse 23, which can be moved into the guide path of the output roller table 1 and which can be removed from the guide path of the output roller table 1. The support traverse 23 is approximately vertically above the swivel axis 15 of the rocker arm 10 in stop position. At least one of the rollers 2,2' of output roller table 1, which rollers are disposed on the output side direction 11 of the slabs, can be provided with a reversible drive. The rocker arm 10 can be formed as a box girder beam with smooth outside surfaces.

In order to transport a slab out of a continuously casting plant, an output roller table 1 is employed where the rollers are designated with 2, 2'. A flame cutting provision, which is not shown here, for subdividing the continuously cast strand into slabs 3 of predetermined length is coordinated to this output roller table 1. The slabs 3 exhibit a flash 4, 4' because of the flame cutting, which flash is called slab flash. The slab flash comprises slag and steel and is disposed at the edges 5,5', which are formed in each case from the lower slab surface 6 and from the flame cut front faces 7,7'. A knife 9 attached to a knife support 8 serves to remove this flash 4, which interferes with the further processing of the slab 3. The knife support 8 is mounted to a knife holder formed as a rocker arm 10. As can be seen from FIG. 1 the rocker arm 10 is movable between two neighboring rollers 2,2' of the output roller table 1 in the output direction 11 of the slab 3 or, respectively, in the opposite direction. The motion is generated by swiveling in the direction of the arrows 12 and 13 around a swivel axis 15 disposed horizontally and parallel to the axis 14 of the rollers 2, 2' or, respectively, parallel to the edge 5 of the slab to be deburred. A two sided impinged pressure means cylinder 16, is preferably a hydraulic cylinder which serves to perform to the swivel motion.

In order to place the knife 9 at the lower surface 6 of the slab 3, the axis 15 of the rocker arm 10 can be lifted up and lowered down. This can be achieved, for example, with a swivel lever 17 which extends in its middle position about horizontally and parallel to the longitudinal direction of the output roller table 1 or, respectively, to the output direction 11 of the slabs 3. The swivel lever 17 pivots around an axis located at a fixed place at one of its ends 18. The other end 19 of the swivel lever 17 is engaged by a spacially fixed support pressure means cylinder 20, with which the swivel axis 15 of the rocker arm 10 disposed between these ends 18 and 19 can be moved in the direction of the lower surface 6 of the slab 3 or, respectively, in the opposite direction.

In order that the edges 5, 5' of a slab 3 take a defined position versus the knife 9 during a cutting operation, two stops 21 and 22 are provided. The stops 21, 22 can be brought into the guide path of the output roller table 1 or, respectively, can be removed from this path, thereby releasing the guide path. These stops 21, 22 are provided at the support traverse 23 in accordance with the embodiment, where the support traverse extends crosswise to the guide path. The support traverse can be lifted and lowered with a lift provision not shown here, such that the support traverse in its lowered position blocks the guide path (FIG. 1) or, respectively, in the lifted where position where the transporting of the slabs 3 is made possible.

One end 21 of the stops 21, 22 serves to stop the front end of the slab 3 in output direction 11, whereas the other end 22 disposed at the opposite side of the support traverse 23 serves to stop the rear end of the slab 3 relative to the output direction at the knife 9. This position is illustrated by the dash-dotted position of the slab 3 shown in FIG. 1. The slab 3 is moved back with a reversible driving support roller 2 of the output roller table 1 after passing the lifted support traverse 23. After moving the slab, 3, opposite to the output direction 11 against the support traverse 23 which was lowered. The knife is now employed to deburr the rear end 5' of the slab 3.

The knife 9 clamped in the knife support 8 is provided with two cutting edges 24, 25, which are formed by the two front faces 26 running parallel to each other, which are also the clamping faces, and by the free surface 27 running at a right angle to the front faces.

The knife 9 can be tilted from a first rest position, A, into a second rest position, B, shown in FIG. 1 with a dash-dotted line, where these two positions, A and B, are approximately symmetrical to the vertical plane 28 passing through the swivel axis 15 of the rocker arm 10.

The two stops 21, 22 are also disposed approximately symmetrical to this plane 28. A carriage 29 for receiving the falling flashes is provided below the rocker arm 10, which carriage 29 can be moved crosswise to the output roller table 1 of the continuous casting plant.

In order to avoid the sticking of falling flashes at the rocker arm 10, the rocker arm 10 is provided as a closed box girder. It comprises a frame 30 and a covering plate 31 mounted to this frame and forming the front and back sides.

Because of the large width of the slabs the pressure means cylinders 16 and 20 as well as the swivel lever 17, are provided twice and in particular on the two sides of the output roller table 1.

The mode of operation of the apparatus is as follows.

After lowering of the support traverse 23 the slab 3 is moved outward until it rests with its flame cut front face 7 at the stop 21. The knife 9 is disposed in position A. Then the swivel lever 17 is swivelled upward until the front cutting edge 24 of the knife 9 rests at the lower slab surface 6. Here the knife 9 is pressed upward with the aid of the pressure means cylinder 20 with a force, which is smaller than the smallest half weight of the slab such that none of the slab is lifted up by the knife 9.

Figure 2:
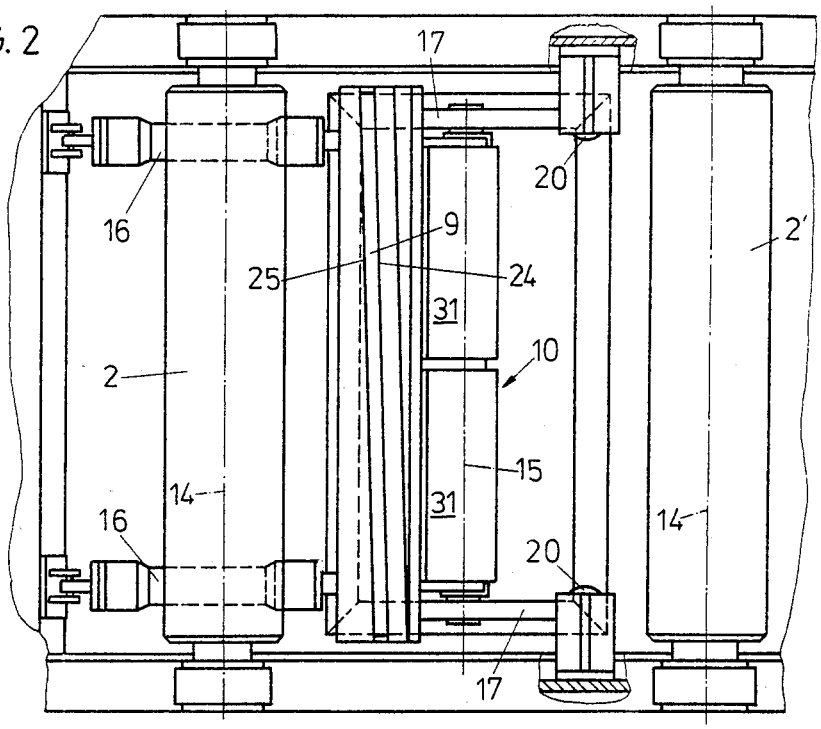
FIG. 2 is a plan view of the apparatus of FIG. 1.
Figure 3:
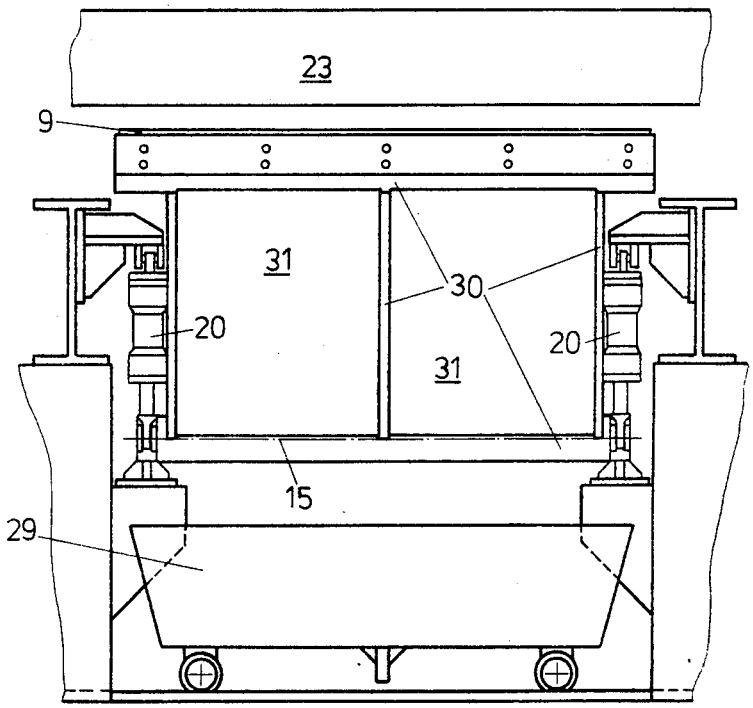
FIG. 3 is a view in the direction of the arrow III of FIG. 1.
Figure 5:
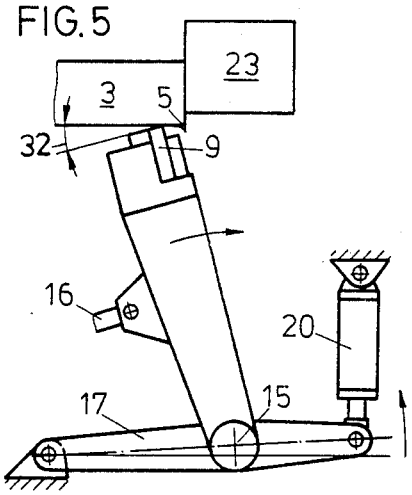
FIG. 5 shows the contacting of the knife edge at the workpiece.
Figure 6:
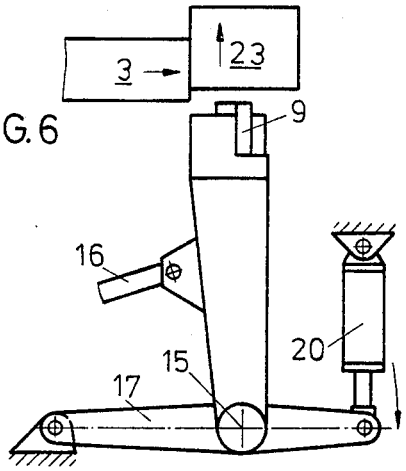
FIG. 6 shows the rocker arm in about vertical position.

The position taken by the knife 9 in this situation is illustrated in FIG. 5, and it can be recognized that the knife forms a positive angle 32 with the slab during the shearing of the flash despite the free surface 27 running at a right angle to the front face 26. The the knife is moved with the aid of a pressure means cylinder 16 over the edge 5 to be deburred. The shearing process is a pulling process based on the inclined position of the knife illustrated in FIG. 2, that is, there is an angle of about 3 degrees which is enclosed by the cutting edges 24, 25 of the knife 9 with the edge 5 to be deburred.

Figure 4:
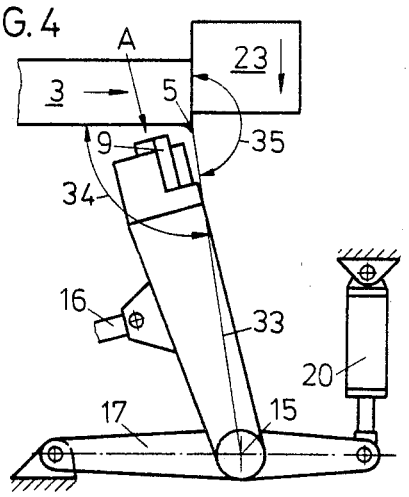
FIG. 4 shows schematically the initial step of deburring operation.
Figure 7:
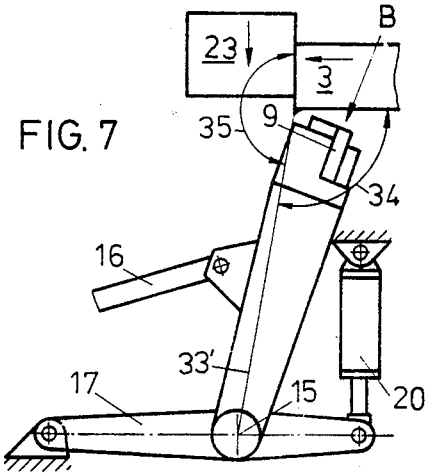
FIG. 7 shows the rocker arm tilted toward the right.
Figure 8:
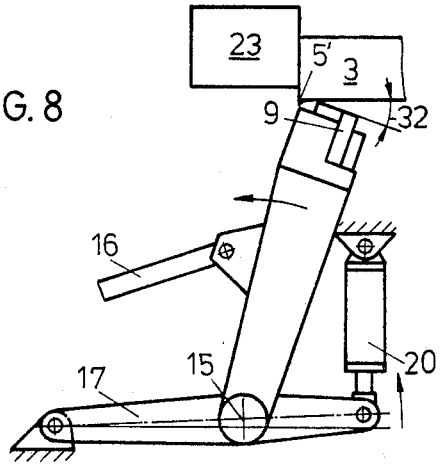
FIG. 8 shows the rocker arm contacting the rear end of a slab.
Figure 9:
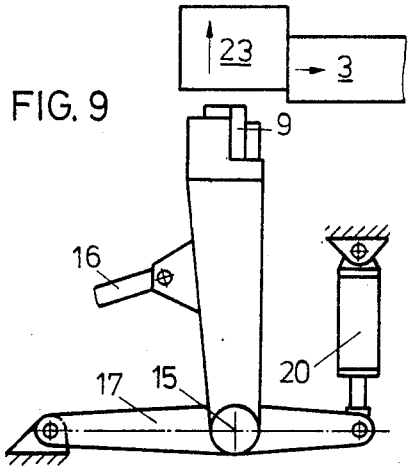
FIG. 9 shows the rocker arm again in an about vertical position.

The knife 9 is disposed in the position B after the lowering of the swivel lever 17 as illustrated in FIG. 7. The support traverse 23 is lifted after a completed shearing of the flash, and the slab 3 is moved up and below the support girder 23 until the rear end of the slab 3 is disposed ahead of the support girder 23, whereupon the support girder 23 is again lowered. The rear flame cut front face 7' of the slab 3 comes into contact 22 based on the return of the slab 3 with aid of a reversible drivable roller 2'. The rocker arm 10 is in a lowered position during this passing. Then the rocker arm 10 is again lifted by the pressure means cylinder 20 until the second rear cutting edge 25 provided at the knife 9 is set to the lower slab surface as illustrated in FIG. 8. Thereupon the knife is swiveled back with aid of the pressure means cylinder 16 along the surface 6 and performs the shearing of the rear flash. After the lifting of the support traverse 23, the knife again reaches the first rest position A as is shown in FIG. 4.

The knife 9 moves by yielding of the pressure means cylinder 20, adjusting the swivel lever along the lower slab surface 6 during shearing process. This means that knife edge moves along an approximately straight line, whereby the angle 32 is in fact decreased: however, it is still present as a finite positive angle even at the termination of the shearing process.

The knife 9 can thus be a simple geometric form and can be employed in two opposite directions for the shearing, where, based on the construction of the knife support as a rocker arm 10, a favorable positive angle 32 can always be maintained.

The angle 32 results in particular by having the straight line 33, 33' drawn between the swivel axis 15 and the part of the knife edge engaging the edge 5, 5' to be deburred with the surfaces 6, 7, 7' of the slab 3 forming the edge 5, 5' to be deburred. This means the angle 34, 35 is larger than 90 degrees.

The invention is not limited to the embodiment illustrated, but can be modified by providing for example an apparatus suitable for the deburring of flashes resulting from scissors cuts, in which case the material to be deburred is advantageously held down, so that it cannot escape and avoid the knife edge. For example, a clamping roll provided above the material to be cut can be furnished. Further it is not indispensable that the rocking arm is disposed at a swivel lever. The swivel lever 15 could be provide in a fixed position, and in particular in those cases where an angle is permissible at the edge to deburred.

It will be understood that each of the elements described above, or two or more together, may also find a useful application in other types of casting system configurations and metal processing procedures differing from the types described above.

While the invention has been illustrated and described as embodied in the context of an apparatus for deburring workpieces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for the deburring of work pieces comprising a frame;

means to support a work piece;

a swivel drive disposed on the frame;

a support lever pivoted at one end on the frame and providing a swivel axis located intermediate between the two ends of the support lever;

means for moving the support lever engaging the support lever at the other end of the support lever;

a rocker arm rotatable around said swivel axis and movable by the swivel drive;

a knife having an edge and mounted at the rocker arm where the length of the knife edge corresponds at least to the length of an edge of the work piece to be deburred, where the rocker arm can be moved past the edge of the work piece to be deburred, where the position of the knife edge versus the edge to be deburred is adjusted by changing the location of the swivel axis of the rocker arm by moving the support lever, and where the swivel axis of the rocker arm is directed about parallel to the edge to be deburred.

2. The apparatus for the deburring of work pieces according to claim 1 wherein the knife edge and the work piece support means are adapted for the deburring of flame cut slabs.

3. The apparatus for the deburring of work pieces according to claim 1 further comprising means for rocking the rocker arm around the swivel axis back and forth relative to the edge of the work piece to be deburred.

4. The apparatus for the deburring of work pieces according to claim 1 further comprising a swivel lever rotatably supporting the swivel axis of the rocker arm; and means for adjusting the position of the swivel lever for pressing against the edge of the workpiece to be deburred and in an opposite direction with a predetermined force.

5. The apparatus for the deburring of work pieces according to claim 1 wherein the shortest straight line connecting the swivel axis of the rocker arm to the part of the knife edge engaging the edge to be deburred encloses obtuse angles $>90$ degrees with the substantially planar surfaces of the work piece forming the edge to be deburred.

6. The apparatus for the deburring of work pieces according to claim 1 wherein two knife edges are provided at the rocker arm and moving with the rocker arm but acting in opposite directions corresponding to the two opposite directions of motion of the rocker arm.

7. The apparatus for the deburring of work pieces according to claim 6 further comprising an output roller table of a continuous casting plant with two neighboring rollers supporting the bottom surface of continuous cast slabs, where the two knife edges are movable between the two neighboring rollers;

a first stop, where the front end, in the output direction of the slab, rests at a distance relative to and away from the vertical position of the rocker arm; and a second stop, where the rear end, relative to the output direction of the slab, rests at a distance relative to and away from the vertical position of the rocker arm.

8. The apparatus for the deburring of work pieces according to claim 7 further comprising a support traverse, which can be brought into the guiding path of the output roller table and which can be removed out of the guiding path of the output roller table, and which support traverse is disposed in stopping position approximately vertical above the swivel axis of the rocker arm.

9. The apparatus for the deburring of work pieces according to claim 7 further comprising a reversible drive connected to at least one of the rollers of the output roller table, where the roller is disposed on the output part of the roller table downstream from the vertical position of the rocker arm.

10. The apparatus for the deburring of work pieces according to claim 7 wherein the rocker arm is provided as a box girder with smooth outer surfaces.

11. The apparatus for the deburring of work pieces according to claim 7 wherein the length of the rocker arm is from about one to eight times the diameter of the rollers on the roller table, where the diameter of the support traverse is from about 0.5 to 2 times the diameter of the rollers on the roller table, and where the location of the swivel axis on the swivel arm from the pivot point of the swivel arm, which is about 0.2 to 2 times the length of the rocker arm.

12. The apparatus for the deburring of work pieces according to claim 7 wherein the length of the rocker arm is from about 1.5 to 5 times the diameter of the rollers on the roller table, where the diameter of the support traverse is from about 0.1 to one times the length of the rocker arm, and where the location of the swivel axis on the swivel arm has a distance from the pivot point of the swivel arm which is about 0.4 to 1 times the length of the rocker arm.

13. The apparatus for the deburring of work pieces according to claim 7 wherein two rocker arms, each with a knife set, are provided around a single swivel axis, where the angle between the two rocker arms is larger than double the angle between a line connecting the swivel axis to the center of the support traverse, and a line the swivel axis to a stop of the support traverse.

14. A method for the deburring of work pieces comprising supporting a work piece on a frame with a swivel drive disposed on the frame;

rotating a rocker arm rotatable around a swivel axis and movable by a swivel drive, where the rocker arm can be moved past the edge of the work piece to be deburred;

adjusting the position of a support lever pivoted at one end on the frame, where the support lever supports a swivel axis of the rocker arm disposed intermediate to the ends of the support lever and the support lever is moved with means for moving the support lever engaged at the other end of the support lever;

engaging the edge of a work piece to be deburred with a knife having an edge and mounted at the rocker arm where the length of the knife edge corresponds at least to the length of an edge of the work piece to be deburred, and where the swivel axis of the rocker arm is directed approximately parallel to the edge to be deburred.

15. The method for the deburring of work pieces according to claim 14 further comprising passing slab sections past the rocker arm for deburring flame cut ends of the slab sections.

16. The method for the deburring of work pieces according to claim 14 further comprising power-moving rocking the rocker arm around the swivel axis back and forth relative to the edge of the work piece to be deburred.

17. The method for the deburring of work pieces according to claim 14 further comprising adjusting the position of the support lever to press against the edge of the workpiece to be deburred, and moving the swivel lever in an opposite direction away from the workpiece with a predetermined force.

18. The method for the deburring of work pieces according to claim 14 further comprising engaging the work piece sequentially with two knife edges provided at the rocker arm acting in opposite directions corresponding to the two opposite directions of motion of the rocker arm during a motion of the rocker arm.

19. The method for the deburring of work pieces according to claim 18 further comprising rolling a continuous cast slab over an output roller table of a continuous casting plant with two neighboring rollers supporting the bottom surface of a continuous cast slab, where the two knife edges are movable between the two neighboring rollers;

stopping the slab at a first stop, where the front end, in the output direction, of the slab rests at a distance relative to and away from the vertical position of the rocker arm;

stopping the slab at a second stop, where the rear end, relative to the output direction, of the slab rests at a distance relative to and away from the vertical position of the rocker arm.

20. The method for the deburring of work pieces according to claim 19 further comprising bringing a support traverse into the guiding path of the output roller table for providing a stop to a slab; and removing the support traverse out of the guiding path of the output roller table, where the support traverse is disposed in stopping position approximately vertically above the swivel axis of the rocker arm.

21. The method for the deburring of work pieces according to claim 19 further comprising moving the slab backward with a roller of the output roller table connected to a reversible drive, where the roller is disposed on the output part of the roller downstream from the vertical position of the rocker arm.

* * * * *